US007555244B2

(12) United States Patent
Idehara et al.

(10) Patent No.: US 7,555,244 B2
(45) Date of Patent: Jun. 30, 2009

(54) IMAGE FORMING APPARATUS WITH A LATENT IMAGE WRITING UNIT POSITIONED AND BIASED AGAINST POSITIONING ERRORS

(75) Inventors: Ryoh Idehara, Hyogo (JP); Nobuhiko Kita, Osaka (JP); Kazuyoshi Kondo, Osaka (JP); Tadashi Okano, Ibaraki (JP); Genta Hagiwara, Osaka (JP); Kaoru Tada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 259 days.

(21) Appl. No.: 11/552,277

(22) Filed: Oct. 24, 2006

(65) Prior Publication Data

US 2007/0110475 A1 May 17, 2007

(30) Foreign Application Priority Data

Nov. 17, 2005 (JP) ..... 2005-332514
Jun. 6, 2006 (JP) ..... 2006-157380

(51) Int. Cl.
*G03G 15/01* (2006.01)
*G03G 15/00* (2006.01)

(52) U.S. Cl. ..... 399/223; 399/118

(58) Field of Classification Search ..... 399/107, 399/118, 177, 205, 223
See application file for complete search history.

(56) References Cited

U.S. PATENT DOCUMENTS 5,041,871 A 8/1991 Hata
2007/0110475 A1 5/2007 Idehara et al.

FOREIGN PATENT DOCUMENTS

| | | | |
|---|---|---|---|
| CN | 1049985 | C | 3/2000 |
| CN | 1161631 | C | 8/2004 |
| CN | 2697693 | Y | 5/2005 |
| JP | 4-243268 | | 8/1992 |
| JP | 2849978 | | 11/1998 |
| JP | 11-219006 | | 8/1999 |
| JP | 3110771 | | 9/2000 |
| JP | 3153103 | | 1/2001 |
| JP | 2003-112446 | | 4/2003 |

OTHER PUBLICATIONS

U.S. Appl. No. 11/552,277, filed Oct. 24, 2006, Idehara, et al.
U.S. Appl. No. 11/623,477, filed Jan. 16, 2007, Idehara, et al.
U.S. Appl. No. 11/758,973, filed Jun. 6, 2007, Kita, et al.
U.S. Appl. No. 12/118,989, filed May 12, 2008, Furuichi, et al.

*Primary Examiner*—Hoang Ngo
(74) *Attorney, Agent, or Firm*—Oblon, Spivak, McClelland, Maier & Neustadt, P.C.

(57) ABSTRACT

In an image forming apparatus, a photoreceptor carries a latent image on its looped surface. An optical writing unit moves between an operating position at which writing of a latent image is performed on the looped surface of the photoreceptor and a standby position at which writing is not performed. A developing device develops the latent image carried on the photoreceptor. A reference position member is located at a reference position for positioning the optical writing unit. A positioning member positions the optical writing unit. A bias coil spring biases the reference position member so that the reference position member contacts the positioning member.

12 Claims, 8 Drawing Sheets

IMAGE FORMING APPARATUS WITH A LATENT IMAGE WRITING UNIT POSITIONED AND BIASED AGAINST POSITIONING ERRORS

CROSS-REFERENCE TO RELATED APPLICATIONS

The present document incorporates by reference the entire contents of Japanese priority document, 2005-332514 filed in Japan on Nov. 17, 2005 and 2006-157380 filed in Japan on Jun. 6, 2006.

BACKGROUND OF THE INVENTION

1. Field of the Invention

The present invention relates to an image forming apparatus.

2. Description of the Related Art

In an electrophotographic image forming apparatus, a latent image writing device such as a laser writing device is widely used. The latent image writing device scans a laser beam onto a uniformly-charged latent image carrying member such as a photoreceptor to write a latent image. Such an image forming apparatus has a problem in that the latent image writing device may interfere with maintenance work on peripheral devices, such as the latent image carrying member and a developing device arranged around the latent image carrying member, depending on their layout.

In an image forming apparatus disclosed in Japanese Patent No. 2849978, a latent image writing device is supported by an open-close cover that can be opened and closed with respect to a fixed cover, and separated widely from the latent image carrying member when the open-close cover is opened. That is, when the open-close cover is opened, the latent image writing device is retracted from a position facing to the latent image carrying member. Thus, the latent image carrying member and the peripheral devices are exposed outside, so that maintenance work for the same is performed efficiently.

In the conventional image forming apparatus, however, an error occurs in relative positions between the latent image writing device supported by the open-close cover and the latent image carrying member supported by the fixed cover because the open-close cover vibrates against the fixed cover. The error decreases the accuracy of a writing position in the latent image writing device. In addition, even though the latent image writing device does not move with an opening or closing movement of the open-close cover and moves singularly or together with any other member, the same problem happens due to a vibration from the latent image writing device.

SUMMARY OF THE INVENTION

It is an object of the present invention to at least partially solve the problems in the conventional technology.

According to an aspect of the present invention, an image forming apparatus includes a latent image carrying member that carries a latent image on a surface thereof, a latent image writing unit that moves between an operating position for writing a latent image on the surface of the latent image carrying member and a standby position, a developing unit that develops the latent image carried on the surface of the latent image carrying member, a reference position member that is located at a reference position for positioning the latent image writing unit, a positioning member that determines a position of the latent image writing unit at the operating position, and a biasing member that biases the reference position member so that the reference position member contacts the positioning member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. In the following, an electrophotographic printer (hereinafter "printer") is described as an image forming apparatus according to an embodiment of the present invention.

Figure 1:
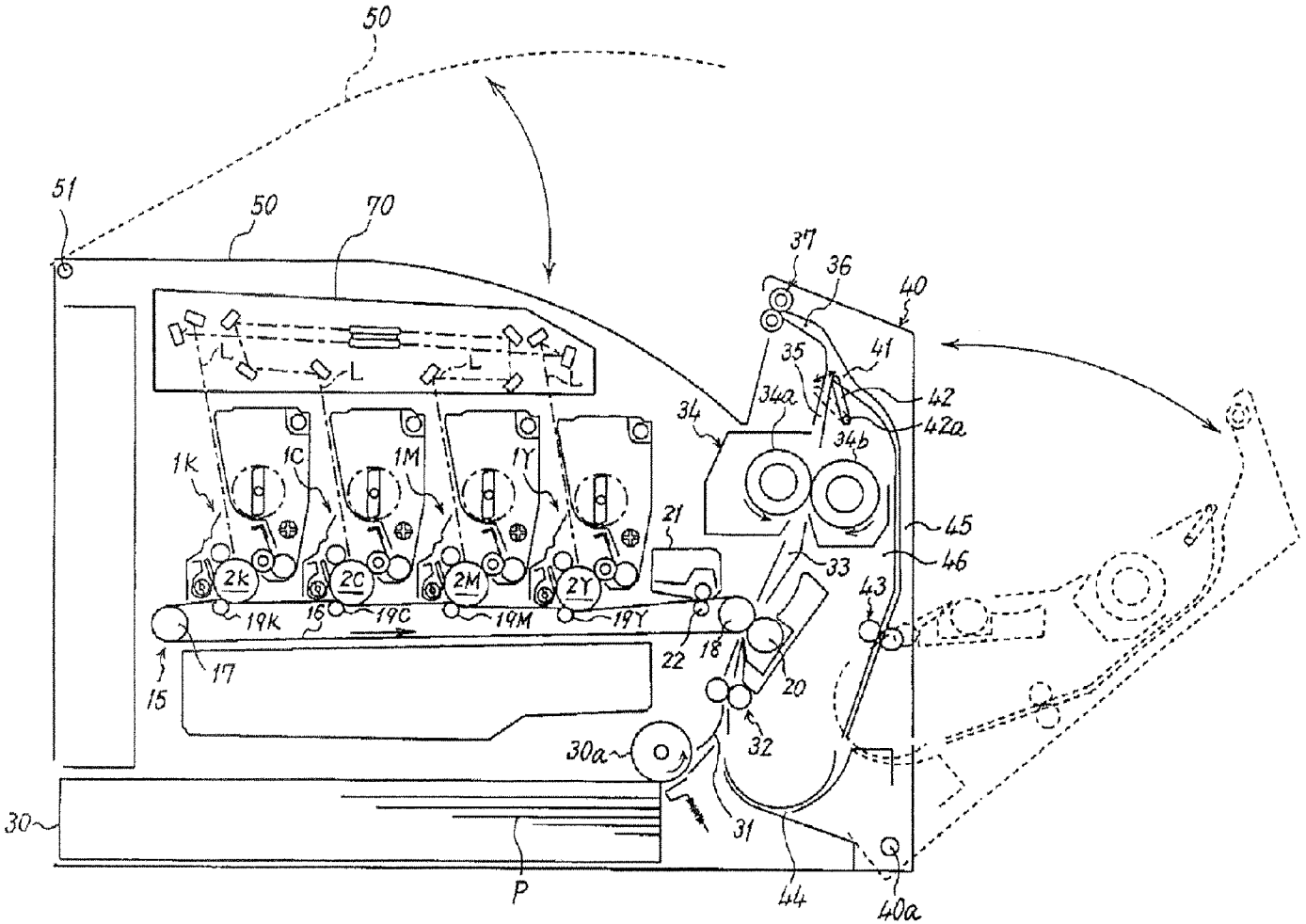
FIG. 1 is a side view of a printer according to an embodiment of the present invention.
Figure 2:
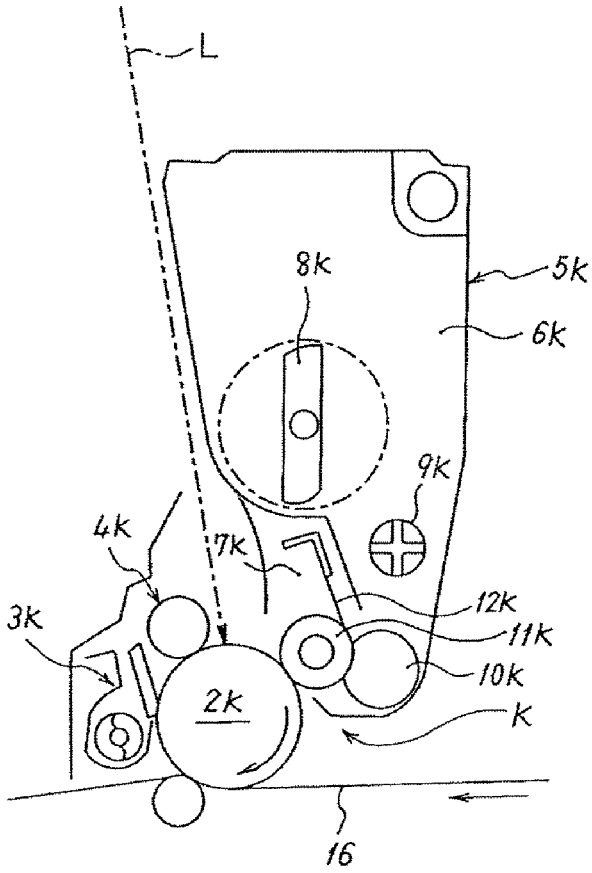
FIG. 2 is an enlarged view of a process unit for black color shown in FIG. 1.

FIG. 1 is a schematic of the printer. The printer includes four process units 1Y, 1M, 1C and 1K that form yellow (Y), magenta (M), cyan (C), and black (K) toner images, respectively. The process units 1Y, 1M, 1C and 1K use toner of different colors to form an image, and otherwise have the same configuration. At the end of the life cycle, the process unit 1 is replaced with a new one. The process unit 1K that forms a K toner image is described as an example. As shown in FIG. 2, the process unit 1K includes a photosensitive drum 2K as a latent image carrying member, a drum cleaning device 3K, a charge neutralizing device (not shown), a charging device 4K, and a developing device 5K. The process unit 1K as an image forming unit is removably attached to the printer. If necessary, the process unit 1K is replaced with a new one.

The charging device 4K uniformly charges a surface of the photosensitive drum 2K that is rotated clockwise by a driving unit (not shown). The uniformly-charged surface of the photosensitive drum 2K is exposed to a laser beam L for scanning, and carries a K latent image. The K latent image is developed into a K toner image by the developing device 5K using K toner (not shown), and intermediately transferred onto an intermediate transfer belt 16. The drum cleaning device 3K cleans residual K toner deposited on the surface of the photosensitive drum 2K after the intermediate transfer. The charge neutralizing device neutralizes residual electric charge on the surface of the photosensitive drum 2K cleaned by the drum cleaning device 3K. After the charge neutralization, the surface of the photosensitive drum 2K is initialized and prepared for the following image forming process. As with the process unit 1K, the other process units 1Y, 1M and 1C form Y, M and C toner images on photosensitive drums 2Y, 2M and 2C, respectively, and the Y, M and C toner images are intermediately transferred onto the intermediate transfer belt 16.

The developing device 5K includes an oblong hopper section 6K that keeps the K toner therein and a developing section 7K. The hopper section 6K includes an agitator 8K that is driven to rotate by a driving unit (not shown), and an agitating paddle 9K that is located vertically downward from the agitator 8K and driven to rotate by a driving unit (not shown), a toner supplying roller 10K that is located vertically downward from the agitating paddle 9K and driven to rotate by a driving unit (not shown). The K toner in the hopper section 6K is agitated by rotations of the agitator 8K and the agitating paddle 9K, and moves towards the toner supplying roller 10K by its own weight. The toner supplying roller 10K includes a metal core and a roller section which coats the surface of the metal core and is formed of resin foam. The toner supplying roller 10K rotates while adhering the K toner in the hopper section 6K to the surface of the roller section therein.

The developing section 7K in the developing device 5K includes a developing roller 11K that rotates while contacting the photosensitive drum 2K and the toner supplying roller 10K, and a thinning blade 12K whose tip contacts a surface of the developing roller 11K. The K toner deposited on the surface of the roller section in the toner supplying roller 10K is supplied to the surface of the developing roller 11K at a position where the developing roller 11K and the toner supplying roller 10K contact each other. When the supplied K toner passes through a position where the developing roller 11K contacts the tip of the thinning blade 12K, a thickness of the K toner layer is regulated by a rotation of the developing roller 11K. Then, the K toner is adhered to a K electrostatic latent image on the surface of the photosensitive drum 2K in a developing area where the developing roller 11K and the photosensitive drum 2K contact each other, and then the K electrostatic latent image is developed to a K toner image.

As with the process unit 1K described above with reference to FIG. 2, the other process units 1Y, 1M and 1C form Y, M and C toner images on surfaces of the photosensitive drums 2Y, 2M and 2C, respectively.

An optical writing unit 70 is located vertically upward from the process units 1Y, 1M, 1C and 1K as shown in FIG. 1. The optical writing unit 70 as a latent image writing device scans the photosensitive drums 2Y, 2M, 2C and 2K in the process units 1Y, 1M, 1C and 1K with the laser beam L emitted from a laser diode based on image information. After scanning, electrostatic latent images for Y, M, C and K colors are formed on the photosensitive drums 2Y, 2M, 2C and 2K, respectively. In addition, the optical writing unit 70 irradiates the photosensitive drums 2Y, 2M, 2C and 2K via a plurality of optical lenses or mirrors with the laser beam L emitted from a light source while polarizing the laser beam in a main scanning direction by a polygon mirror driven to rotate by a polygon motor (not shown). Optical writing can be performed with light emitted from a plurality of light-emitting diodes (LEDs) in an LED array.

A transfer member 15, on which the intermediate transfer belt 16 is extended in a loop, rotates the intermediate transfer belt 16 counterclockwise. The transfer member 15 is located vertically downward from the process units 1Y, 1M, 1C and 1K. The transfer member 15 includes the intermediate transfer belt 16, a drive roller 17, a driven roller 18, four primary transfer rollers 19Y, 19M, 19C and 19K, a secondary transfer roller 20, a belt cleaning device 21, a cleaning backup roller 22.

The intermediate transfer belt 16 is spanned around the drive roller 17, the driven roller 18, the cleaning backup roller 22, and the primary transfer rollers 19Y, 19M, 19C and 19K. The intermediate transfer belt 16 rotates counterclockwise due to a rotation force of the drive roller 17 driven to rotate counterclockwise by a driving unit (not shown).

The primary transfer rollers 19Y, 19M, 19C and 19K hold the intermediate transfer belt 16 with the photosensitive drums 2Y, 2M, 2C and 2K. Four primary transfer nip portions for Y, M, C and K colors are formed between the photosensitive drums 2Y, 2M, 2C and 2K and a surface of the intermediate transfer belt 16, respectively.

A transfer bias supply (not shown) applies primary transfer biases to the primary transfer rollers 19Y, 19M, 19C and 19K. Thus, transfer electric fields are formed between the electrostatic latent images on the photosensitive drums 2Y, 2M, 2C and 2K and the primary transfer rollers 19Y, 19M, 19C and 19K, respectively. A transfer charger or a transfer brush can be employed instead of the primary transfer rollers 19Y, 19M, 19C and 19K.

When the Y toner image formed on the photosensitive drum 2Y in the process unit 1Y comes to the primary transfer nip portion for Y color with a rotation of the photosensitive drum 2Y, the Y toner image is primarily transferred from the photosensitive drum 2Y onto the intermediate transfer belt 16 by the transfer electric field and a nip pressure. When the intermediate transfer belt 16, on which the Y toner image has been primarily transferred, moves and passes through the primary transfer nip portions for M, C and K colors, the M, C and K toner images on the photosensitive drums 2M, 2C and 2K are primarily transferred onto the intermediate transfer belt 16 and sequentially overlapped on the Y toner image. Thus, a four-color toner image is formed on the intermediate transfer belt 16.

The secondary transfer roller 20 in the transfer member 15 is located outside the loop of the intermediate transfer belt 16, and holds the intermediate transfer belt 16 with the driven roller 18 located inside the loop of the intermediate transfer belt 16. A secondary transfer nip portion is formed between the secondary transfer roller 20 and the driven roller 18. The transfer bias supply (not shown) applies a secondary transfer bias to the secondary transfer roller 20. Accordingly, a secondary-transfer electric field is formed between the secondary transfer roller 20 and the earthed driven roller 18.

A paper feeding cassette 30 that contains a bundle of recording sheets P is located vertically downward from the transfer member 15, and slide removably attached to the printer. The paper feeding cassette 30 includes a paper feeding roller 30*a* that contacts on top of the bundle of the recording sheets P, and rotates the paper feeding roller 30*a* counterclockwise at a predetermined timing to feed the recording sheet P towards a paper feeding path 31.

Paired paper stop rollers 32 are arranged near the end of the paper feeding path 31. Upon holding the recording sheet P from the paper feeding cassette 30, the paired paper stop rollers 32 stop rotating. The paired paper stop rollers 32 start rotating at timing capable of synchronizing the recording sheet P with the four-color toner image on the intermediate transfer belt 16 to feed the recording sheet P to the secondary transfer nip portion.

The four-color toner image on the intermediate transfer belt 16, which is closely contacted on the recording sheet P at the secondary transfer nip portion, is secondarily transferred onto the recording sheet P by the secondary transfer electric field and a nip pressure. The four-color toner image is combined with a white color of the recording sheet P, resulting in a full-color toner image. After passing through the secondary transfer nip portion, the recording sheet P with the full-color toner image formed thereon is separated from the secondary transfer roller 20 and the intermediate transfer belt 16 by the curvature. The recording sheet P is fed into a fixing device 34 via a post-transfer conveying path 33.

Residual toner that has not been transferred onto the recording sheet P remains on the intermediate transfer belt 16 having passed through the secondary transfer nip portion. The belt cleaning device 21 that contacts a front surface of the intermediate transfer belt 16 removes the residual toner from the intermediate transfer belt 16. The cleaning backup roller 22 backs up the belt cleaning device 21, and cleans up inside the loop of the intermediate transfer belt 16.

The fixing device 34 includes a fixing roller 34*a* including a heat generating source such as a halogen lamp (not shown), and a pressure roller 34*b*. The pressure roller 34*b* rotates and contacts the fixing roller 34*a* at a predetermined pressure, thereby forming a fixing nip portion with the fixing roller 34*a*. The recording sheet P fed into the fixing device 34 is held at the fixing nip portion, so that the fixing roller 34*a* is closely contacted on a surface of the recording sheet P that carries a non-fixed toner image. The toner in the toner image is softened by the heat and pressure, and a full-color toner image is fixed on the recording sheet P.

The recording sheet P discharged from the fixing device 34 passes through a post-fix conveying path 35, and comes to a fork between a paper discharging path 36 and a pre-reversal conveying path 41. A switching claw 42 that is driven to rotate around a rotating shaft 42*a* is arranged on the one side of the post-fix conveying path 35. An end of the post-fix conveying path 35 is closed or opened due to a rotation of the switching claw 42. When the recording sheet P is discharged from the fixing device 34, the switching claw 42 stops rotating at a position indicated by the solid line, and the end of the post-fix conveying path 35 is opened. The recording sheet P is conveyed from the post-fix conveying path 35 to the paper discharging path 36, and held between paired paper discharging rollers 37.

When the single-sided printing mode is set up by an input on an operating section such as a numeric keypad (not shown) or a control signal transmitted from a personal computer (not shown), the recording sheet P is discharged from the printer. Then, the recording sheet P is stacked on a stack section located on a top surface of a top cover 50.

When the duplex printing mode is set up, a tip of the recording sheet P is held by the paired paper discharging rollers 37, and the recording sheet P is conveyed through the paper discharging path 36. When a rear-end of the recording sheet P passes through the post-fix conveying path 35, the switching claw 42 rotates and moves to a position indicated by the dashed line, and the end of the post-fix conveying path 35 is closed. At the same time, the paired paper discharging rollers 37 start rotating in the reverse direction. The recording sheet P is conveyed into the pre-reversal conveying path 41 from the rear-end side.

FIG. 1 depicts the printer from an anterior view. Namely, the printer faces to the front side of the drawing in a perpendicular direction. The back side, right side, and left side of the drawing denote the rear face, right face, and left face of the printer accordingly. A reverse member 40 located in the right edge of the printer can be opened by rotating around a rotating shaft 40*a*. When the paired paper discharging rollers 37 rotate in the reverse direction, the recording sheet P is fed into the pre-reversal conveying path 41 in the reverse member 40, and conveyed from upward to downward in the vertical direction. Then, the recording sheet P passes through paired reverse conveying rollers 43, and is conveyed into a semicircularly-curved reverse conveying path 44. The recording sheet P is reversed upside-down along the semicircular curve of the reverse conveying path 44, and conveyed from downwards to upward in the vertical direction. The recording sheet P passes through the paper feeding path 31, and is conveyed into the secondary transfer nip portion again. The full-color image is secondarily transferred in batch onto a reverse side of the recording sheet P. Then, the recording sheet P is conveyed to the post-transfer conveying path 33, the fixing device 34, the post-fix conveying path 35, the paper discharging path 36, and the paired paper discharging rollers 37 sequentially, and then discharged from the printer.

The reverse member 40 includes an outside cover 45 and an oscillating member 46. More specifically, the outside cover 45 is rotatably supported by the rotating shaft 40*a* in the printer. The outside cover 45 including the oscillating member 46 is opened from or closed to the printer by rotating around the rotating shaft 40*a*. When the outside cover 45 including the oscillating member 46 is opened as indicated by the dotted line, the paper feeding path 31, the secondary transfer nip portion, the post-transfer conveying path 33, the fixing nip portion, the post-fix conveying path 35, and the paper discharging path 36 those formed between the reverse member 40 and the main body of the printer are divided into two parts and exposed outside. Therefore, if the recording sheet P is jammed in the paper feeding path 31, the secondary transfer nip portion, the post-transfer conveying path 33, the fixing nip portion, the post-fix conveying path 35, or the paper discharging path 36, the jammed recording sheet P is easily removed.

When the outside cover 45 is opened, the oscillating member 46 is rotatably supported by the outside cover 45, and is capable of rotating around an oscillating shaft (not shown). When the oscillating member 46 is opened from the outside cover 45 by rotating around the oscillating shaft, the pre-reversal conveying path 41 and the reverse conveying path 44 are divided into two parts and exposed outside. Therefore, if the recording sheet P is jammed in the pre-reversal conveying path 41 or the reverse conveying path 44, the jammed recording sheet P is easily removed.

The top cover 50 is rotatably supported by a shaft member 51. The top cover 50 is opened by rotating counterclockwise around the shaft member 51 as indicated by an arrow, and an upper opening of the printer is exposed outside widely.

Figure 3:
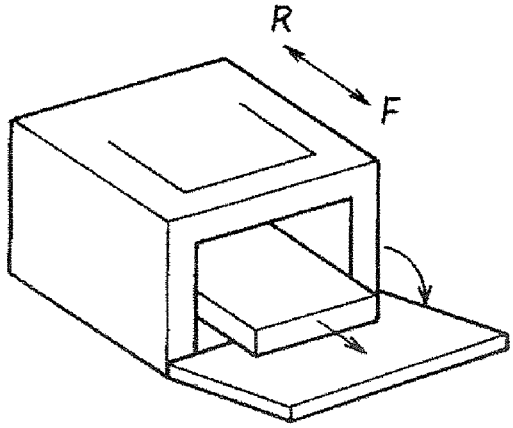
FIG. 3 is a perspective view for explaining maintenance work on the printer by opening a front cover thereof.
Figure 4:
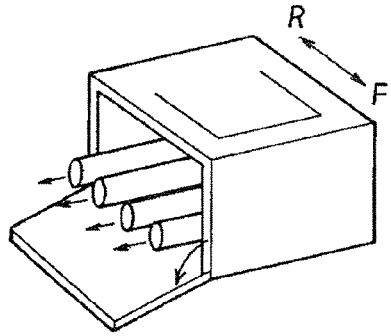
FIG. 4 is a perspective view for explaining maintenance work on the printer by opening a left cover thereof.
Figure 5:
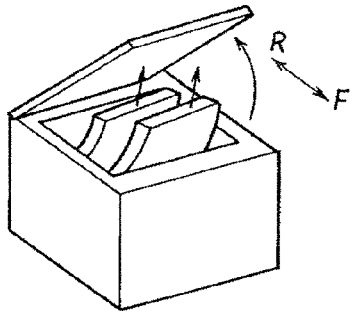
FIG. 5 is a perspective view for explaining maintenance work on the printer by opening a top cover thereof.

Recently, the image forming apparatus is expected to include internal members or devices capable of being attached and removed easily without sacrificing the possibilities such as downsizing, weight saving, and the high operation performance. FIGS. 3 to 5 depict methods of removing the internal members or devices from the printer. In FIG. 3, a front cover of the printer is opened in F direction indicated by an arrow. In FIG. 4, a left cover of the printer is opened. In FIG. 5, a top cover of the printer is opened. If the internal members or devices are relatively often removed and attached, the top cover is preferably opened as shown in FIG. 5 to allow a user to remove and attach the internal members or devices while viewing inside the printer without having to squat down or bend down. Thus, the user can reduce a work load and also prevent mishandling. In addition, a copy paper receiving tray and a scanner are generally mounted on the top of the image forming apparatus because of the high visibility.

In the printer, for example, the process units 1Y, 1M, 1C and 1K are replaced with new ones when the developing device runs out the toner, and therefore relatively often attached and removed. When the top cover is opened as shown in FIG. 5 to replace any one of the process units 1Y, 1M, 1C and 1K, the process units 1Y, 1M, 1C and 1K need to be arranged abreast. It is assumed that the process units 1Y, 1M, 1C and 1K are arranged longitudinally. For example, when the process unit 1C arranged at the third highest is to be replaced, not only the process unit 1C but also the process units 1Y and 1M those arranged at the first and second highest need to be removed. Therefore, the operability of the printer is significantly far from the user-friendliness.

Thus, the process units 1Y, 1M, 1C and 1K are advantageously arranged abreast. Therefore, the intermediate transfer belt 16 is spanned landscape around the photosensitive drums 2Y, 2M, 2C and 2K. The process units 1Y, 1M, 1C and 1K are to be arranged either vertically upward from the intermediate transfer belt 16 as shown in FIG. 1, or vertically downward from the intermediate transfer belt 16. When the process units 1Y, 1M, 1C and 1K are arranged vertically downward from the intermediate transfer belt 16, the optical writing unit 70 is to be arranged landscape to scan the photosensitive drums 2Y, 2M, 2C and 2K, and is also to be arranged vertically downward from the process units 1Y, 1M, 1C and 1K. Namely, in contradiction to the layout in FIG. 1, the optical writing unit 70, the process units 1Y, 1M, 1C and 1K, and the intermediate transfer belt 16 are arranged in the ascending order sequentially. However, when the recording sheet P is conveyed from downward to upward in the vertical direction, the fixing device 34 is to be arranged above the intermediate transfer belt 16 where the secondary transfer nip portion is formed. This causes an empty space at the left side of the fixing device 34. Thus, it is difficult to achieve the downsizing and space-saving of the printer.

Therefore, in the printer according to the embodiment, the process units 1Y, 1M, 1C and 1K are arranged abreast and above the intermediate transfer belt 16 as shown in FIG. 1. The landscape optical writing unit 70 is arranged above the process units 1Y, 1M, 1C and 1K. The process units 1Y, 1M, 1C and 1K and the optical writing unit 70 are arranged beside the fixing device 34 for space-saving.

Even though the process units 1Y, 1M, 1C and 1K are arranged abreast either vertically upward or vertically downward from the intermediate transfer belt 16, when any one of the process units 1Y, 1M, 1C and 1K is replaced, the optical writing unit 70 or the intermediate transfer belt 16 is to be moved away from the process units 1Y, 1M, 1C and 1K. For example, when the process units 1Y, 1M, 1C and 1K are arranged above the intermediate transfer belt 16, the optical writing unit 70 is to be arranged above the process units 1Y, 1M, 1C and 1K as shown in FIG. 1. In the layout, when the top cover 50 is opened, the process units 1Y, 1M, 1C and 1K are not exposed because the optical writing unit 70 is arranged above the process units 1Y, 1M, 1C and 1K. Therefore, the optical writing unit 70 is to be moved away from the process units 1Y, 1M, 1C and 1K to replace the process unit 1. Even when the process units 1Y, 1M, 1C and 1K are arranged below the intermediate transfer belt 16, the intermediate transfer belt 16 is to be moved away from the process units 1Y, 1M, 1C and 1K to replace the process unit 1.

From the aspect of the downsizing and space-saving of the printer, the process units 1Y, 1M, 1C and 1K are arranged above the intermediate transfer belt 16, and the optical writing unit 70 is arranged above the process units 1Y, 1M, 1C and 1K. Therefore, when any one of the process units 1Y, 1M, 1C and 1K is replaced, the optical writing unit 70 is to be moved away from the process units 1Y, 1M, 1C and 1K. In the printer according to the embodiment of the present invention, the optical writing unit 70 is slidably supported by a frame of the printer, and can be removed by sliding vertically, when the top cover is opened. Alternatively, an end of the optical writing unit 70 is rotatably supported by the frame of the printer, and rotates away from the process units 1Y, 1M, 1C and 1K or rotates to locate over the process units 1Y, 1M, 1C and 1K. Otherwise, the optical writing unit 70 is held on the bottom of the open-close top cover 50, and moves away from the process units 1Y, 1M, 1C and 1K or moves to locate over the process units 1Y, 1M, 1C and 1K according to an opening or closing movement of the top cover 50.

However, even though the optical writing unit 70 is arranged anywhere as described above, an error relating to relative positions occurs between the optical writing unit 70 and the photosensitive drums 2Y, 2M, 2C and 2K due to a vibration of the slidable or rotatable optical writing unit 70 or a vibration of the top cover 50. Therefore, the writing position accuracy in the optical writing unit 70 decreases because of the error in relative positions between the optical writing unit 70 and the photosensitive drums 2Y, 2M, 2C and 2K. Additionally, a blur, void, and vignetting of the image are caused by the decrease of the writing position accuracy. In addition, when the printer includes a plurality of process units, a color drift of the image is also caused by the decrease of the writing position accuracy.

Figure 6:
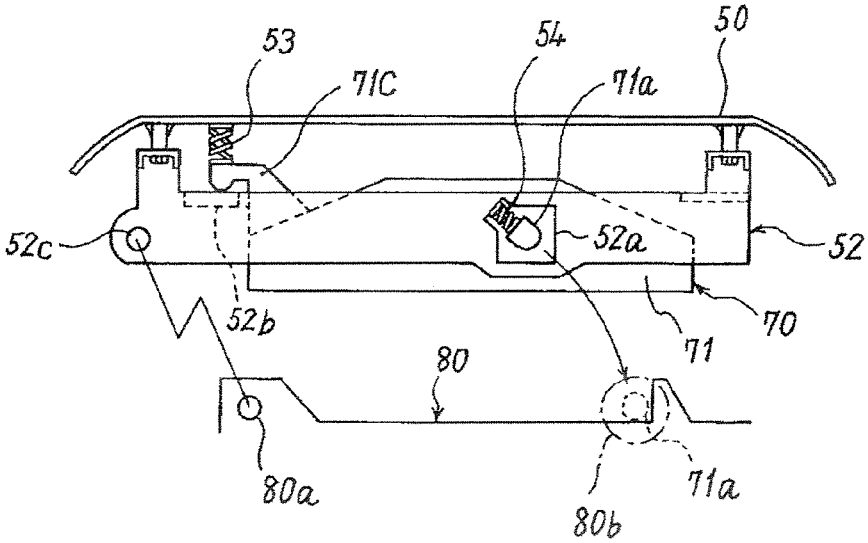
FIG. 6 is an enlarged view of the top cover and peripheral members in the printer.

Next, a characteristic configuration of the printer is described. FIG. 6 is an enlarged view of the top cover 50 and peripheral members in the printer. A cover frame 52 as a holding member is fixed to the reverse side of the top cover 50, and holds the optical writing unit 70. More specifically, the cover frame 52 includes a front plate and a back plate that are facing each other in an anteroposterior direction (in a direction perpendicular to the drawing sheet) at a predetermined distance, and a rib (not shown) that connects the front plate with the back plate. The front plate and the back plate respectively include a rectangular hole 52*a*. The hole 52*a* on the front plate and the hole 52*a* on the back plate are facing each other. The optical writing unit 70 includes a protruding cylindrical first reference position member 71*a* on a front wall of a casing 71, and a protruding cylindrical second reference position member (not shown) on a back wall of the casing 71. Those reference position members extend on the same shaft line. The optical writing unit 70 is arranged between the front plate and the back plate of the cover frame 52. The first reference position member 71*a* is inserted into the hole 52*a* on the front plate. The second reference position member is inserted into the hole 52*a* on the back plate (not shown) of the cover frame 52. The optical writing unit 70 further includes a hook section 71*c* on the top left corner of the casing 71. The hook section 71*c* is biased in a direction to be moved away from the top cover 50 by a coil spring 53 fixed to a bottom surface of the top cover 50, and strikes on a striking section 52*b* in the cover frame 52. The first reference position member 71*a* and the second reference position member are respectively inserted into the hole 52*a* in the cover frame 52, and the hook section 71*c* strikes on the striking section 52*b* in the cover frame 52, so that the optical writing unit 70 is held by the cover frame 52.

In addition, the cover frame 52 that is integrated with the top cover 50 can be applicable.

The holes 52*a* on both the front and back plates of the cover frame 52 are considerably larger than a diameter of the first reference position member 71*a* or the second reference position member in the optical writing unit 70. The optical writing unit 70 is movably held by the cover frame 52, and can move freely within a clearance between the hole 52*a* and the first reference position member 71*a* or the second reference position member.

A shaft hole 52*c* is formed on the left end of both the front and back plates of the cover frame 52. Inside the printer, a front side plate 80 is arranged in an upright posture near the front face of the printer, and includes a shaft hole 80*a* on the top left corner. A back side plate (not shown) is also arranged in an upright posture near the rear face of the printer, facing to the front side plate 80 with a predetermined space from the front side plate 80, and also includes a shaft hole on the top left corner. The left end of the cover frame 52 is inserted between the front side plate 80 and the back side plate. The shaft member 51 (see FIG. 1, not shown in FIG. 6) is set to penetrate the shaft hole 80*a* on the front side plate 80, the shaft hole 52*c* on the front plate of the cover frame 52, the shaft hole 52*c* on the back plate of the cover frame 52, and the shaft hole on the back side plate sequentially. Therefore, the top cover 50, the cover frame 52, and the optical writing unit 70 are rotatably supported by the front side plate 80 and the back side plate in the printer, and can rotate around the shaft member 51.

The optical writing unit 70 supported by the cover frame 52 can move between a standby position not-facing to any of the process units 1Y, 1M, 1C and 1K and an operating position facing to the process units 1Y, 1M, 1C and 1K according to an opening or closing movement of the top cover 50.

The front and back plates of the cover frame 52 respectively include a hook (not shown) on the right end. When the top cover 50 is closed, the hooks are engaged with an expandable pin (not shown) on the front side plate 80 and the back side plate, respectively. Therefore, the right end of the cover frame 52 cannot move when the top cover 50 is closed. The movement of the left end of the cover frame 52 is controlled by the shaft member 51 (see FIG. 1). A combination of movement controlling members such as the shaft member 51, the expandable pin, and the hook on the right end of the cover frame 52 controls the movement of the cover frame 52 at the operating position.

As shown in FIG. 6, a first bias coil spring 54 as a first biasing member is fixed to the front plate of the cover frame 52. The first bias coil spring 54 biases the first reference position member 71*a*, which is inserted into the hole 52*a* in the cover frame 52, in an oblique direction from top left to bottom right. In FIG. 6, the first reference position member 71*a* is located in the middle of the hole 52*a*. However, when the top cover 50 is opened, the first reference position member 71*a* is biased by the first bias coil spring 54 and pressed to the bottom right corner on an inner wall of the hole 52*a*, and the optical writing unit 70 is held by the cover frame 52. In addition, a second bias coil spring (not shown) as a second biasing member is fixed to the back plate of the cover frame 52. The second bias coil spring biases the second reference position member in an oblique direction from top left to bottom right as viewed from the front face of the printer.

Figure 8:
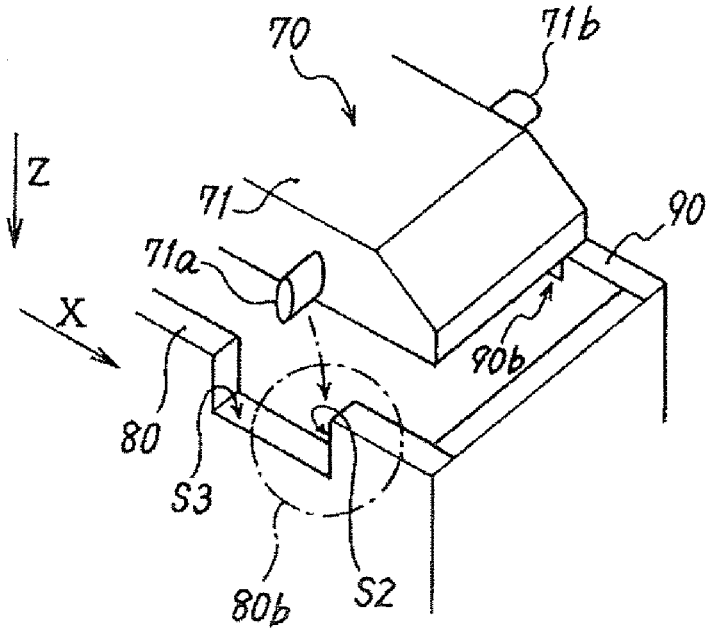
FIG. 8 is a perspective view of the right end inside the printer.
Figure 9:
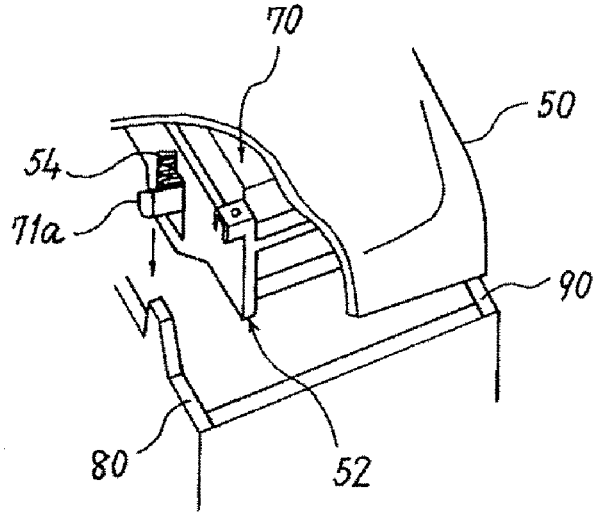
FIG. 9 is a perspective view of the right end of the printer.

As shown in FIGS. 8 and 9, a first positioning section 80*b* is arranged on the upper side of the front side plate 80. The first positioning section 80*b* determines a position of the optical writing unit 70 that moves to the operating position when the top cover 50 is closed. The first positioning section 80*b* includes two contact surfaces that contact the first reference position member 71*a* biased by the first bias coil spring 54 (see FIG. 6). One of the contact surfaces is a second direction control surface S2 that controls the movement of the first reference position member 71*a* in a second direction indicated by arrow X. The second direction indicated by arrow X is perpendicular to an anteroposterior direction (a direction perpendicular to the drawing sheet) that is a latent image writing direction (a main scanning direction) of the optical writing unit 70. Also, the second direction indicated by arrow X is the horizontal direction (horizontal direction in the drawing sheet) that is a moving direction at the latent image writing position (the optical writing position) on the surface of the photosensitive drum 2. The other contact surface is a third direction control surface S3 that controls the movement of the first reference position member 71*a* in a third direction indicated by arrow Z.

Figure 7:
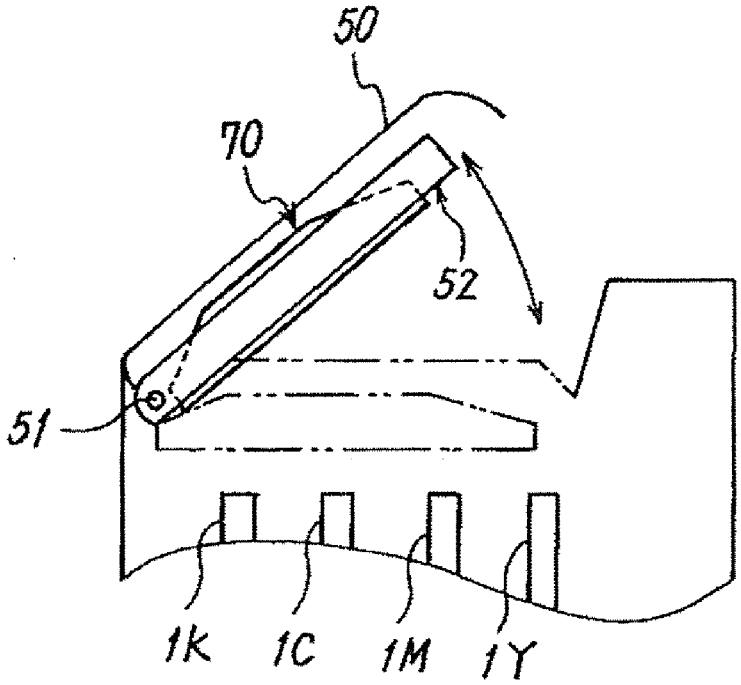
FIG. 7 is a schematic for explaining opening and closing movement of the top cover.
Figure 10:
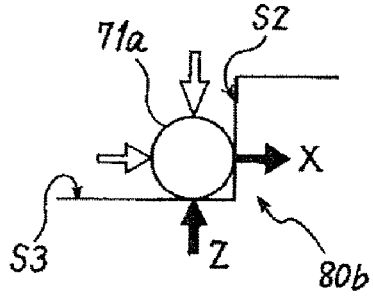
FIG. 10 is a schematic for explaining a condition where a first reference position member of an optical writing unit in the process unit contacts a first positioning section in the printer.

The first reference position member 71*a* moves in an arc around the shaft member 51 as shown in FIG. 7. However, when the first reference position member 71*a* contacts the third direction control surface S3 in the first positioning section 80*b* (see FIG. 8), the first reference position member 71*a* moves in the direction indicated by arrow Z as shown in FIG. 10. In addition, the second direction indicated by arrow X is also a first direction perpendicular to the latent image writing direction of the optical writing unit 70. Namely, the second direction control surface S2 in the printer is also a first direction control surface. In the printer, the direction indicated by arrow X is the same as that in which the photosensitive drums 2Y, 2M, 2C and 2K are aligned.

A bias direction of the first bias coil spring 54 is set so that a direction of the bias component force is to be along the direction indicated by arrow X. The direction indicated by arrow X is the second direction from the left side to the right side. An opposite direction to the direction indicated by arrow X, namely, a direction from the right side to the left side is also the second direction that is perpendicular to the scanning direction of the optical writing unit 70. Therefore, the bias direction of the first bias coil spring 54 can be set so that the direction of the bias component force is to be opposite to the direction indicated by arrow X. Therefore, the first reference position member 71*a* can be positioned in the direction X by contacting on the contact surface extending in the direction Z with the bias force of the first bias coil spring 54. However, the first reference position member 71*a* is preferably positioned in the direction X by setting the direction of the bias component force to be along the direction indicated by arrow X as shown in FIG. 10. In FIG. 10, the second direction control surface S2 is located at a position intersected with a movement locus of the first reference position member 71*a* according to the opening or closing movement of the top cover 50. In this configuration, the first reference position member 71*a* can contact the second direction control surface S2 naturally because the first reference position member 71*a* moves on the movement locus. Meanwhile, when the direction of the bias component force is along the opposite direction to the direction indicated by arrow X, the second direction control surface S2 is to be located inside the movement locus of the first reference position member 71*a*. However, in the state, the first reference position member 71*a* cannot contact the second direction control surface S2 naturally. Therefore, the first reference position member 71*a* is also to be moved inside the movement locus by the bias force of the first bias coil spring 54. However, when the first reference position member 71*a* moves on the movement locus, the first reference position member 71*a* is already biased maximally by the first bias coil spring 54. Thus, when the first reference position member 71*a* is to be moved inside the movement locus by the bias force of the first bias coil spring 54, it is necessary to take some measures. For example, the first reference position member 71*a* is pushed onto a curved surface guiding member with a surface curved along the movement locus of the first reference position member 71*a* by the bias force of the first bias coil spring 54, so that the first reference position member 71*a* moves while being restricted in a position before where the first reference position member 71*a* is biased maximally. When the first reference position member 71*a* moves close, to some extent, to the second direction control surface S2, the first reference position member 71*a* is separated from the curved surface guiding member and moved towards the bias direction to contact the second direction control surface S2. However, this disadvantageously increases the cost and is not preferable.

Figure 11:
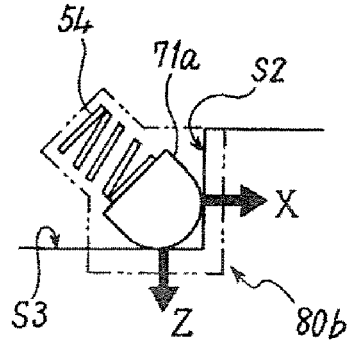
FIG. 11 is a schematic of the first reference position member biased by a first bias coil spring and peripheral members.

The first bias coil spring 54 (not shown in FIG. 10) that biases the first reference position member 71*a* can include two coil springs, i.e., one biasing the first reference position member 71*a* in the direction X and the other in the direction Z. However, as the number of coils increases, both the cost and the size of the device are getting increased disadvantageously. Therefore, the printer according to the embodiment is configured as shown in FIG. 11 and employs the first bias coil spring 54 that biases the first reference position member 71*a* to move in an oblique direction including the direction X and the direction Z. Therefore, the cost saving and downsizing of the printer can be achieved. In the same manner as the first reference position member 71*a*, the second reference position member is biased to move in the oblique direction by the second bias coil spring. In addition, an angle θ between the first or second reference position member and the second direction control surface S2 is within the range from more than 0 degree to less than 90 degrees.

The first bias coil spring 54 biases the first reference position member 71*a* being at the operating position when the top cover 50 is closed (see FIG. 6), and the first reference position member 71*a* strikes on both the second and third direction control surfaces S2 and S3 in the first positioning section 80*b*. Therefore, the front end of the optical writing unit 70 at the operating position is positioned both in the direction X and in the direction Z.

As shown in FIG. 8, a second positioning section 90*b* that determines a position of the optical writing unit 70 at the operating when the top cover 50 is closed is arranged above a back side plate 90 located behind the front side plate 80. The second positioning section 90*b* includes two contact surfaces that contact a second reference position member 71*b* biased by a second bias coil spring (not shown). One of the contact surfaces is a second direction control surface that controls the movement of the second reference position member 71*b* in the direction indicated by arrow X. The other contact surface is a third direction control surface that controls the movement of the second reference position member 71*b* in the direction indicated by arrow Z.

The second bias coil spring fixed to the back plate (not shown) of the cover frame 52 biases the second reference position member 71*b* at the operating position as shown in FIG. 8, and the second reference position member 71*b* strikes on both the second and third direction control surfaces in the second positioning section 90*b*. Therefore, the back end of the optical writing unit 70 at the operating position is positioned both in the direction X and in the direction Z.

In the printer configured as described above, the optical writing unit 70 moves between the operating position and the standby position due to a rotation of the top cover 50 when necessary. Therefore, the optical writing unit 70 can move away from the process units 1Y, 1M, 1C and 1K including the photosensitive drums 2Y, 2M, 2C and 2K and peripheral members. Thus, when the process units 1Y, 1M, 1C and 1K are exposed outside, the process units 1Y, 1M, 1C and 1K can be maintained efficiently.

The reference position members 71*a* and 71*b* of the optical writing unit 70 at the operating position are contacted on the positioning sections 80*b* and 90*b* by the bias force of the bias coil springs, so that the optical writing unit 70 is positioned relating to the photosensitive drums 2Y, 2M, 2C and 2K. Therefore, even though the cover frame 52 holding the movable optical writing unit 70 moves with a certain vibration, the optical writing unit 70 can be positioned relating to the photosensitive drums 2Y, 2M, 2C and 2K. Thus, the writing position accuracy of the optical writing unit 70 is prevented from decreasing.

The first reference position member 71*a* is arranged at an end (the front end) of the optical writing unit 70 in the latent image writing direction (in the anteroposterior direction), and the second reference position member 71*b* is arranged at the other end (the rear end) of the optical writing unit 70. When both the first and second reference position members 71*a* and 71*b* contact the second direction control surface S2, the optical writing unit 70 is positioned in the direction indicated by arrow X, which is perpendicular to the latent image writing direction at both the ends of the optical writing unit 70 and equal to the moving direction of the optical writing unit 70 at the operating position on the surface of the photosensitive drum 2. Therefore, the latent image writing direction on the surface of the photosensitive drum 2 is accurately positioned perpendicular to the moving direction of the optical writing unit 70. Thus, it is possible to prevent the latent image writing direction (the direction perpendicular to the moving direction) on the surface of the photosensitive drum 2 from skewing. In other words, it is possible to prevent the images from skewing on the recording sheet P.

The direction indicated by arrow X is equal to the direction in which the photosensitive drums 2Y, 2M, 2C and 2K are aligned. Therefore, it is also possible to prevent the latent image writing direction on the photosensitive drums 2Y, 2M, 2C and 2K from skewing. It is also possible to prevent the relative position displacement of the Y, M, C and K toner images, namely, the displacement of overlapping the Y, M, C and K toner images (color drift).

In addition, when both the first and second reference position members 71*a* and 71*b* contact the third direction control surface S3, the optical writing unit 70 is positioned in the moving direction. Therefore, it is possible to prevent a skew between the first reference position member 71*a* and the second reference position member 71*b*.

Figure 12:
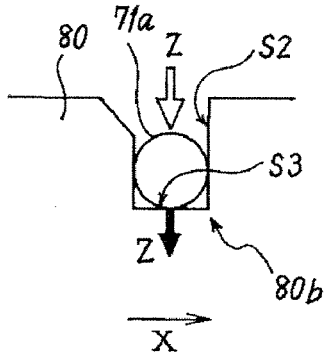
FIG. 12 is a schematic of another example of the first positioning section.
Figure 13:
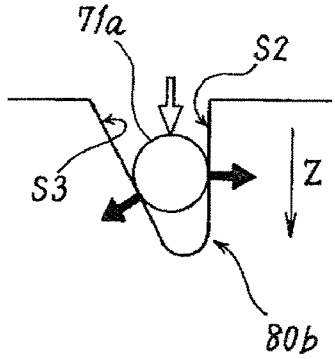
FIG. 13 is a schematic of yet another example of the first positioning section.

The first positioning section 80*b* in the front side plate 80 can be configured as shown in FIG. 12. In FIG. 12, the first positioning section 80*b* includes a slit extending from the upper end to the lower end of the front side plate 80. The first reference position member 71*a* contacts both side walls of the slit. The first reference position member 71*a* can move by sliding vertically in the slit. When the optical writing unit 70 is set on, the first reference position member 71*a* strikes on the bottom wall of the slit that is the third direction control surface S3. Then, when the first reference position member 71*a* is biased in the direction indicated by arrow Z by the first bias coil spring 54 (not shown in FIG. 12), the front end of the optical writing unit 70 is positioned in the direction indicated by arrow Z. When the first reference position member 71*a* is rubbed against the second direction control surface S2 that is one of the side walls, the front end of the optical writing unit 70 is positioned in the direction indicated by arrow X.

However, with this configuration, when the optical writing unit 70 moves from the operating position to the standby position, the optical writing unit 70 is to be moved vertically (in the direction indicated by arrow Z) by a length of the slit, and cannot move in an arc on the movement path. Therefore, the printer cannot allow the optical writing unit 70 held by the top cover 50 to move between the operating position and the standby position according to the opening or closing movement of the top cover 50. Thus, the optical writing unit 70 is to be separated from the top cover 50, and to be removed or attached without relation to the opening or closing movement of the top cover 50. In addition, if the first reference position member 71*a* contacts firmly on both the side walls of the slit, the first reference position member 71*a* cannot move by sliding vertically in the slit. Therefore, it is necessary to provide a clearance at approximately 0.05 millimeter to 0.5 millimeter between the first reference position member 71*a* and each side wall of the slit. Thus, the first reference position member 71*a* and therefore the optical writing unit 70 are vibrated in the direction X by approximately 0.05 millimeter to 0.5 millimeter, and the writing position accuracy decreases.

Thus, the printer according to the embodiment of the present invention is configured as shown in FIG. 11 in which there is no opposite surface to the second direction control surface S2 in the first positioning section 80*b*, and the first reference position member 71*a* is biased by the first bias coil spring 54 to contact the second direction control surface S2. In this configuration, even though the first reference position member 71*a* moves in an arc on the movement path, the first reference position member 71*a* is not stuck in the first positioning section 80*b* because there is a free space at the opposite side of the second direction control surface S2. Therefore, the printer is configured such that the optical writing unit 70 rotates together with the top cover 50. Namely, it is not necessary to remove or attach the optical writing unit 70 when the top cover 50 is opened or closed. Further, the first reference position member 71*a* is reliably struck on the second direction control surface S2 by the bias force of the first bias coil spring 54. Therefore, it is possible to prevent from decreasing the writing position accuracy of the optical writing unit 70 due to the vibration of the first reference position member 71*a* in the direction X. In addition, as already described above, the second positioning section 90*b* has the same configuration as the first positioning section 80*b*.

The first positioning section 80*b* can be arranged on the front side plate 80. In this case, the third direction control surface S3 in the first positioning section 80*b* is inclined to the second direction control surface S2 in the direction Z. Therefore, the first reference position member 71*a* can rotate according to the opening or closing movement of the top cover 50. However, as the top cover 50 is repeatedly opened and closed, the first reference position member 71*a* is getting worn away by rubbing against the third direction control surface S3. Thus, the positioning accuracy of the first reference position member 71*a* in the direction Z is also getting decreased.

Thus, the printer according to the embodiment of the present invention is configured as shown in FIG. 11. That is, the first reference position member 71*a* is not rubbed against the third direction control surface S3, but struck on the third direction control surface S3. Therefore, it is possible to prevent the first reference position member 71*a* from wearing due to the rub against the third direction control surface S3. Thus, the first reference position member 71*a* is accurately positioned in the direction Z over a long period of time.

Figure 14:
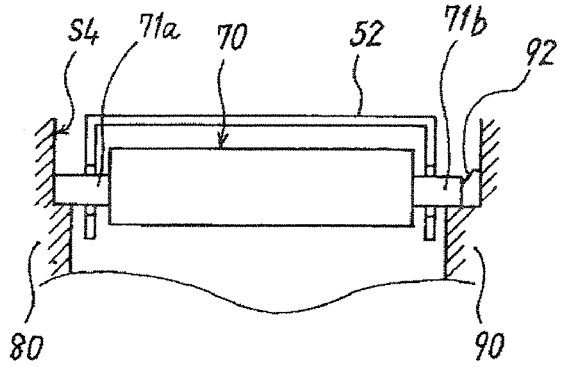
FIG. 14 is a cross-section of the optical writing unit and peripheral members viewed from the right side of the printer.
Figure 15:
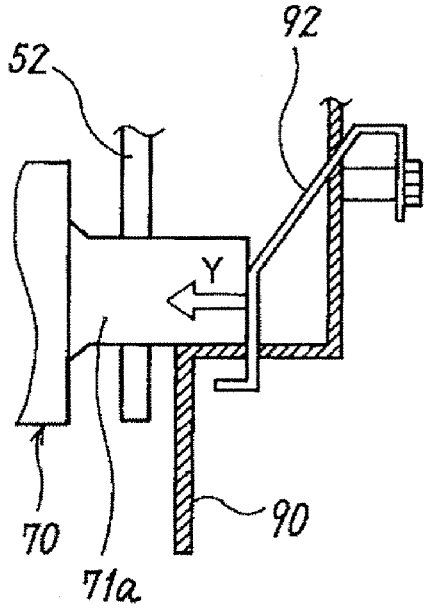
FIG. 15 is an enlarged cross-section of the back end of the optical writing unit and peripheral members.

FIG. 14 is a cross-section of the optical writing unit 70 and peripheral members viewed from the right side of the printer. FIG. 15 is an enlarged cross-section of the rear end of the optical writing unit 70 and the peripheral members. A plate spring 92 as a third biasing member is fixed to a surface of the back side plate 90 facing to the front side plate 80. The plate spring 92 contacts the edge face of the second reference position member 71*b* in the optical writing unit 70 at the operating position, and biases the optical writing unit 70 in a fourth direction (the latent image writing direction) indicated by arrow Y. The optical writing unit 70 is biased towards the front side plate 80 that is a third positioning section, and the edge face of the first reference position member 71*a* is struck on a fourth direction control surface S4 that is a surface of the front side plate 80 facing to the back side plate 90. Therefore, the optical writing unit 70 is restricted to moving in the fourth direction, and the optical writing unit 70 is positioned in the direction indicated by arrow Y. Thus, the writing position accuracy can increase.

As described above, in the printer according to the embodiment of the present invention, the writing position of the optical writing unit 70 is determined in the all directions X, Y, and Z perpendicular to one another. Thus, the high writing position accuracy can be obtained.

In addition, a coil spring can be used as the third biasing member instead of the plate spring 92. The plate spring 92 as the third biasing member can be fixed to the cover frame 52 of the top cover 50. However, the reaction force against the bias force of the plate spring 92 in the direction Y acts on the cover frame 52 direct. Therefore, the top cover 50 is forced by the reaction force from the main body of the printer. As a result, the top cover 50 is displaced or twisted against the main body of the printer. Meanwhile, when the plate spring 92 is fixed to the back side plate 90, the reaction force against the bias force of the plate spring 92 in the direction Y does not act on the cover frame 52 direct.

Figure 16:
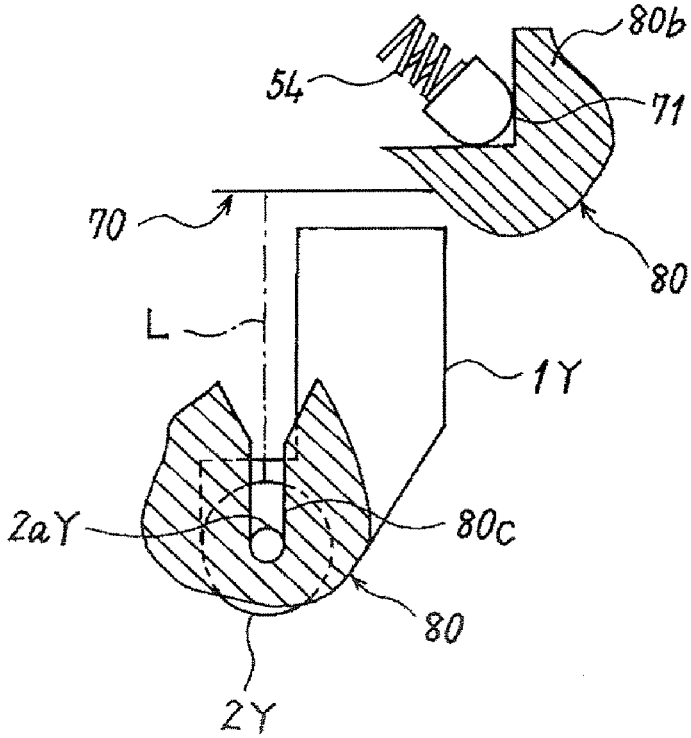
FIG. 16 is an enlarged view of a process unit for yellow color and peripheral members shown in FIG. 1.

FIG. 16 is an enlarged view of the process unit 1Y and peripheral members in the printer. The front side plate 80 includes a slit 80*c* extending from upward to downward in the vertical direction. When a front drum shaft 2*a*Y located in the front end of the photosensitive drum 2Y in the process unit 1Y is inserted into the slit 80*c*, the front end of the process unit 1Y is supported slide-movably in the vertical direction (direction Z) by the front side plate 80. The rear end of the process unit 1Y is supported slide-movably in the vertical direction (direction Z) by the back side plate 90 (not shown) in the same manner. The process unit 1Y can be mounted on or removed from the printer in the vertical direction. Both the front and back side plates 80 and 90 include three more slits (not shown) that slide-movably support the process units 1M, 1C, and 1K, respectively. Thus, both the front and back side plates 80 and 90 serve as a supporting member that supports the photosensitive drums 2Y, 2M, 2C and 2K slide-movably in the attaching and removing direction. The plurality of slits on both the front and back side plates 80 and 90 serves as a latent image carrying member positioning section that determines a position of the drum shaft as a reference position section of the photosensitive drums 2Y, 2M, 2C and 2K.

Figure 17:
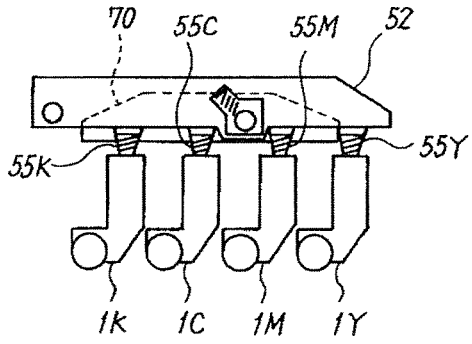
FIG. 17 is a schematic of a cover frame of the optical writing unit and four process units shown in FIG. 1.
Figure 18:
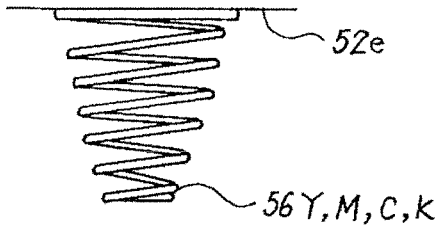
FIG. 18 is an enlarged view of a process unit bias spring fixed to the cover frame.

FIG. 17 is a schematic of the cover frame 52 of the optical writing unit 70 and the process units 1Y, 1M, 1C and 1K. The process units 1Y, 1M, 1C and 1K are fixed to the bottom surface of the front plate of the cover frame 52 by process unit bias springs 55Y, 55M, 55C and 55K, respectively. The process units 1Y, 1M, 1C and 1K are fixed to the bottom surface of the back plate 52*e* of the cover frame 52 by process unit bias springs 56Y, 56M, 56C and 56K, respectively (see FIG. 18). When the top cover 50 is closed, the process unit bias springs 55Y, 55M, 55C and 55K, and 56Y, 56M, 56C and 56K respectively bias the process units 1Y, 1M, 1C and 1K vertically downwards (in the direction Z). To take the photosensitive drum 2Y as an example, when the front drum shaft 2*a*Y (see FIG. 16) and a back drum shaft (not shown) are struck on the bottom surface of the slit, the photosensitive drum 2Y is positioned in the direction Z. The other photosensitive drums 2M, 2C and 2K are also positioned in the direction Z in the same manner.

The process unit bias springs 55Y, 55M, 55C and 55K, and 56Y, 56M, 56C and 56K as latent image supporting member biasing members can be arranged in the printer. However, in such a case, the process unit bias springs 55Y, 55M, 55C and 55K, and 56Y, 56M, 56C and 56K interfere in attaching and removing the process units 1Y, 1M, 1C and 1K. Therefore, in this case, the process unit bias springs 55Y, 55M, 55C and 55K, and 56Y, 56M, 56C and 56K are to be attached removably. When any one of the process units 1Y, 1M, 1C and 1K is removed and attached, the process unit bias springs 55 and 56 corresponding to the process unit are also to be removed and attached. In the printer according to the embodiment of the present invention, the process unit bias springs 55Y, 55M, 55C and 55K, and 56Y, 56M, 56C and 56K are respectively fixed to the process units 1Y, 1M, 1C and 1K. Therefore, the process unit bias springs 55Y, 55M, 55C and 55K, and 56Y, 56M, 56C and 56K do not interfere in attaching and removing the process units 1Y, 1M, 1C and 1K. Thus, the cumbersome operation as described above can be omitted.

Figure 19:
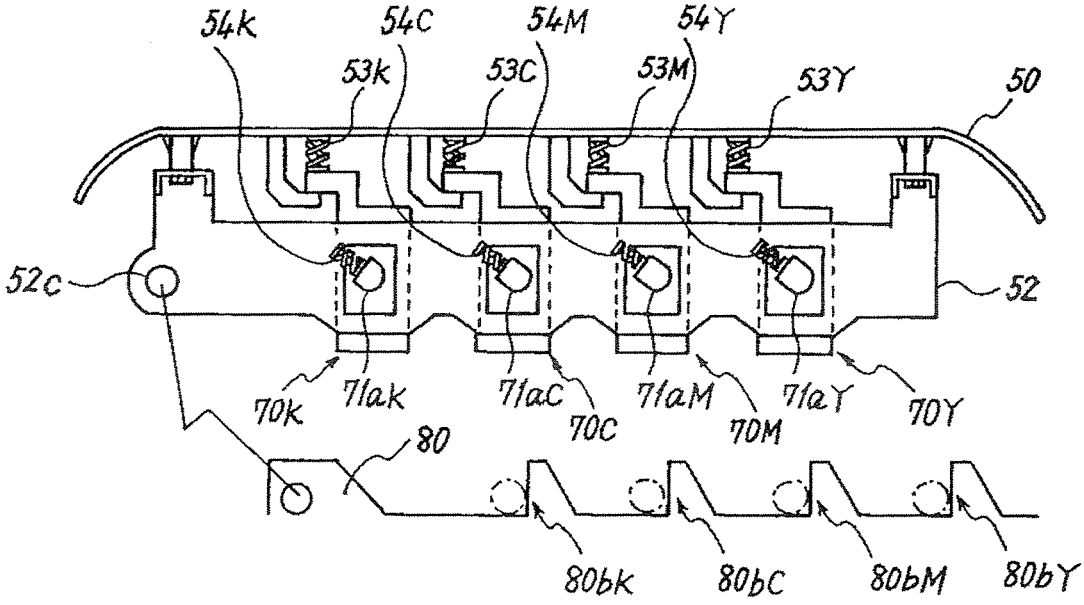
FIG. 19 is a schematic of the top cover and peripheral members in a modification of the printer.

FIG. 19 is a schematic of the top cover 50 and peripheral members in a modification of the printer. The variant printer includes four optical writing units 70Y, 70M, 70C and 70K for Y, M, C and K colors as a latent image writing device that optically scan with an LED array. The optical writing units 70Y, 70M, 70C and 70K include first reference position members 71*a*Y, 71*a*M, 71*a*C and 71*a*K, and first bias coil springs 54Y, 54M, 54C, 54K that bias the first reference position members 71*a*Y, 71*a*M, 71*a*C and 71*a*K, respectively. The optical writing units 70Y, 70M, 70C and 70K further include four second reference position members (not shown) and four second bias coil springs (not shown). In addition, a semiconductor laser diode or a polygon mirror can be used for optical scanning instead of the LED array.

The front side plate 80 includes first positioning sections 80*b*Y, 80*b*M, 80*b*C and 80*b*K that determine positions of the optical writing units 70Y, 70M, 70C and 70K, respectively.

In the printer described above, the mono-component development method is employed such that the printer develops a latent image with a mono-component developer including toners mainly and without including a magnetic carrier. The present invention is applicable to an image forming apparatus that develops a latent image by a two-component development method using a two-component developer including a toner and a magnetic carrier.

In addition, the printer according to the present invention is not limited to the optical writing unit 70 that can be moved according to the opening and closing movement of the top cover 50, and includes, for example, an optical writing unit that rotates singularly and moves away from a position facing to the process units 1Y, 1M, 1C and 1K. The present invention is also applicable to the image forming apparatus in which the optical writing unit 70 does not rotate but moves by sliding.

In the printer according to the embodiment, the first and second positioning sections 80*b* and 90*b* respectively include a first direction control surface that controls the movement of the reference position members 71*a* and 71*b* in the first direction that is perpendicular to the moving direction of the optical writing unit 70 as the latent image writing device, and the reference position members 71*a* and 71*b* are contacted on the first direction control surface by the bias force of the bias coil spring as the biasing member. Thus, the optical writing unit 70 can be positioned in the first direction.

The first and second positioning sections 80*b* and 90*b* further include the second direction control surface S2 that controls the movement of the reference position members 71*a* and 71*b* in the second direction (in the direction X: the first direction) perpendicular to the latent image writing direction (direction Y) of the optical writing unit 70, and the reference position members 71*a* and 71*b* are contacted on the second direction control surface S2 by the bias force of the bias coil spring. Thus, the optical writing unit 70 can be positioned in the second direction.

The first and second positioning sections 80*b* and 90*b* further include the third direction control surface S3 that controls the movement of the reference position members 71*a* and 71*b* in the third direction (in the direction Z) that is the moving direction of the optical writing unit 70 in addition to the second direction control surface S2, and the reference position members 71*a* and 71*b* are contacted on both the second and third direction control surfaces S2 and S3 by the bias force of the bias coil spring. Thus, the optical writing unit 70 can be positioned in the second and third directions.

The cover frame 52 serves as a supporting member of the optical writing unit 70. The optical writing unit 70 is movably supported by the cover frame 52, and the cover frame 52 moves together with the optical writing unit 70. The bias coil spring, for example, the first bias coil spring 54 is supported by the cover frame 52, so that the reference position members 71*a* and 71*b* that are biased by the first bias coil spring 54 can move with the optical writing unit 70 integrally.

The cover frame 52 includes a supporting member operation controlling member that controls the cover frame 52 to be opened or closed at the operating position. Therefore, the cover frame 52 prevents from vibrating due to the reaction force of the bias coil spring at the operating position, so that it is possible to prevent the writing position accuracy of the optical writing unit 70 from decreasing due to the vibration.

The printer includes the photosensitive drums 2Y, 2M, 2C and 2K. The direction in which the photosensitive drums 2Y, 2M, 2C and 2K are aligned in the printer is equal to the second direction. Therefore, the optical writing unit 70 can be positioned in the direction in which the photosensitive drums 2Y, 2M, 2C and 2K are aligned.

The optical writing unit 70 includes the first reference position member 71*a* located in the front end in the optical scanning direction (direction Y) and the second reference position member 71*b* located in the rear end as reference position members. The optical writing unit 70 further includes the first positioning section 80*b* located on the front side plate 80 that contacts the first reference position member 71*a*, and the second positioning section 90*b* located on the back side plate 90 that contacts the second reference position member 71*b* as positioning sections. The optical writing unit 70 further includes the first bias coil spring 54 as the first biasing member that biases the first reference position member 71*a* so that the first reference position member 71*a* contacts the first positioning section 80*b*, and the second bias coil spring as the second biasing member that biases the second reference position member 71*b* so that the second reference position member 71*b* contacts the second positioning section 90*b*. As described above, the latent image writing direction on the surface of the photosensitive drums 2Y, 2M, 2C and 2K is accurately determined to be perpendicular to the moving direction on the surface of the photosensitive drums 2Y, 2M, 2C and 2K to prevent a skew in the latent image writing direction on the surface of the photosensitive drums 2Y, 2M, 2C and 2K. Thus, the image can be prevented from skewing on the recording sheet P. It is also possible to prevent a skew in the latent image writing direction on the surface of the photosensitive drums 2Y, 2M, 2C and 2K. Therefore, it is possible to prevent a relative position displacement and an overlapping displacement of respective color toner images (color drift).

The printer includes the third positioning section (a portion of the front side plate 80) including the fourth direction control surface S4 that controls the movement of the first reference position member 71*a* in the fourth direction (direction Y) that is the optical scanning direction, and the plate spring 92 as the third biasing member that biases the optical writing unit 70 to make the first reference position member 71*a* contact the fourth direction control surface S4 in the printer. In this configuration, the optical writing unit 70 can be positioned in the direction Y.

The printer includes the front and back side plates 80 and 90 as supporting members inside it. The front and back side plates 80 and 90 are slidably engaged with the front drum shaft 2*a*Y and the back drum shaft as positioning sections for the photosensitive drums 2Y, 2M, 2C and 2K. Therefore, the front drum shaft 2*a*Y and the back drum shaft can move by sliding from the operating position of the photosensitive drums 2Y, 2M, 2C and 2K to the operating position of the optical writing unit 70, and are rotatably supported at the operating position of the photosensitive drums 2Y, 2M, 2C and 2K. The front and back side plates 80 and 90 can release the engagement with the front drum shaft 2*a*Y and the back drum shaft that are moved by sliding at a predetermined distance from the operating position of the photosensitive drums 2Y, 2M, 2C and 2K to the operating position of the optical writing unit 70. The process unit bias springs 55Y, 55M, 55C and 55K, and 56Y, 56M, 56C and 56K as latent image carrying member biasing members contact each of the photosensitive drums 2Y, 2M, 2C and 2K supported by the front and back side plates 80 and 90 on the bottom of the slits as latent image carrying member positioning sections that bias the photosensitive drums 2Y, 2M, 2C and 2K towards the operating position. The photosensitive drums 2Y, 2M, 2C and 2K can be attached and removed easily by sliding, and positioned in the direction Z that is the attaching and removing direction.

The process unit bias springs 55Y, 55M, 55C and 55K, and 56Y, 56M, 56C and 56K are held by the cover frame 52 as a holding member. Therefore, when any one of the process units 1Y, 1M, 1C and 1K is attached or removed, it is not necessary to attach or remove the process unit bias springs 55 and 56 corresponding to the process unit 1. Thus, maintenance of the process units 1Y, 1M, 1C and 1K can be improved.

As set forth hereinabove, according to an embodiment of the present invention, a latent image writing device is moved from an operating position to a standby position, when necessary, so that the latent image writing device is separated from a latent image carrying member and peripheral devices. With this separation, the latent image carrying member and the peripheral devices are exposed outside. Thus, maintenance of the latent image carrying member and the peripheral devices can be improved.

Moreover, a reference position member in the latent image writing device at the operating position is contacted on a positioning section in an image forming apparatus by a bias force of a biasing member, so that the latent image writing device is positioned with respect to the latent image carrying member in the image forming apparatus. Consequently, even if the movable latent image writing device moves with a certain vibration against the image forming apparatus, the latent image writing device is positioned at the operating position with respect to the latent image carrying member in the image forming apparatus. Thus, it is possible to prevent decrease in the writing position accuracy of the latent image writing device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a latent image carrying member that carries a latent image on a surface thereof;

a latent image writing unit that moves between an operating position for writing a latent image on the surface of the latent image carrying member and a standby position;

a developing unit that develops the latent image carried on the surface of the latent image carrying member;

a reference position member that is located at a reference position for positioning the latent image writing unit;

a positioning member that determines a position of the latent image writing unit at the operating position; and a biasing member that biases the reference position member so that the reference position member contacts the positioning member, the baising member configured to bias the reference position member such that the reference position member exerts a force on two perpendicular sufaces of the positioning member when the latent image writing unit is in the operating position.

2. The image forming apparatus according to claim 1, wherein the positioning member includes a first direction control surface that controls movement of the reference position member in a first direction perpendicular to a moving direction of the latent image writing unit, and the biasing member biases the reference position member so that the reference position member contacts the first direction control surface.

3. An image forming apparatus, comprising:

a latent image carrying member that carries a latent image on a surface thereof;

a latent image writing unit that moves between an operating position for writing a latent image on the surface of the latent image carrying member and a standby position;

a developing unit that develops the latent image carried on the surface of the latent image carrying member;

a reference position member that is located at a reference position for positioning the latent image writing unit;

a positioning member that determines a position of the latent image writing unit at the operating position; and a biasing member that biases the reference position member so that the reference position member contacts the positioning member, wherein the latent image writing unit scans a light beam on the surface of the latent image carrying member to write the latent image thereon, the positioning member includes a second direction control surface that controls movement of the reference position member in a second direction perpendicular to a scanning direction of the latent image writing unit, and the biasing member biases the reference position member so that the reference position member contacts the second direction control surface.

4. The image forming apparatus according to claim 2, wherein the positioning member further includes a third direction control surface that controls movement of the reference position member in a third direction being the moving direction of the latent image writing unit, and the biasing member biases the reference position member so that the reference position member contacts both the first direction control surface and the third direction control surface.

5. The image forming apparatus according to claim 3, wherein the positioning member further includes a third direction control surface that controls movement of the reference position member in a third direction being the moving direction of the latent image writing unit, and the biasing member biases the reference position member so that the reference position member contacts both the second direction control surface and the third direction control surface.

6. The image forming apparatus according to claim 1, further comprising a holding member that moves together with the latent image writing unit while movably supporting the latent image writing unit, and supports the biasing member.

7. The image forming apparatus according to claim 6, further comprising a movement controlling member that controls movement of the holding member at the operating position.

8. The image forming apparatus according to claim 3, further comprising:

a plurality of the latent image carrying members, wherein the second direction is a direction in which the latent image carrying members are aligned.

9. The image forming apparatus according to claim 8, wherein the reference position member includes a first reference position member located at a first end of the scanning direction, and a second reference position member located a second end of the scanning direction, the positioning member includes a first positioning member that contacts the first reference position member, and a second positioning member that contacts the second reference position member, and the biasing member includes a first biasing member that biases the first reference position member so that the first reference position member contacts the first positioning member, and a second biasing member that biases the second reference position member so that the second reference position member contacts the second positioning member.

10. The image forming apparatus according to claim 9, further comprising:

a third positioning member including a fourth direction control surface that controls movement of any one of the first reference position member and the second reference position member in a fourth direction being the scanning direction; and a third biasing member that biases the latent image writing unit so that any one of the first reference position member and the second reference position member contacts the fourth direction control surface.

11. The image forming apparatus according to claim 8, further comprising:

a supporting member that is engaged with a reference positioning member of the latent image carrying member so that the reference positioning member is slide-movable from the operating position of the latent image carrying member to the operating position of the optical writing unit, rotatably supports the reference positioning member at the operating position of the latent image carrying member, and releases the engagement with the reference positioning member that has moved by a predetermined distance from the operating position of the latent image carrying member to the operating position of the optical writing unit; and a latent image carrying member biasing member that biases the latent image carrying member supported by the supporting member towards the operating position.

12. The image forming apparatus according to claim 11, wherein the latent image carrying member biasing member is held by the holding member.

* * * * *